US006382987B1

(12) United States Patent
Yu

(10) Patent No.: US 6,382,987 B1
(45) Date of Patent: May 7, 2002

(54) ELECTRONIC CARD CONNECTOR WITH IMPROVED ADAPTER DEVICE

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/797,645

(22) Filed: Mar. 1, 2001

(30) Foreign Application Priority Data

Dec. 15, 2000 (TW) ..... 89221832 U

(51) Int. Cl.[7] ..... H01R 12/00
(52) U.S. Cl. ..... 439/79; 439/607
(58) Field of Search ..... 439/607, 609, 439/101, 79, 701

(56) References Cited

U.S. PATENT DOCUMENTS 6,116,925 A * 9/2000 Tung ..... 439/101
6,238,240 B1 * 5/2001 Yu ..... 439/541.5

* cited by examiner

*Primary Examiner*—Khiem Nguyen
(74) *Attorney, Agent, or Firm*—Wei Te Chung

(57) ABSTRACT

An electronic card connector includes an insulative housing (10) , a plurality of conductive contacts(12, 14) retained in the housing, a conductive plate (20) and an adapter device (30). The conductive plate forms a shielding section (21) covering a top of the housing and a grounding section (23) extending vertically from the shielding section. The adapter device comprises an orientation member (40) for orientating the conductive contacts and the grounding section, and an adapter (50) for mating and retaining to a circuit board. The adapter has a symmetric structure and includes a dielectric body (52) and a plurality of pairs of conductive terminals (56) and grounding contacts (58) retained in opposite sides of the dielectric body for conductively contacting the contacts and the grounding section of the conductive plate, respectively.

12 Claims, 4 Drawing Sheets

ELECTRONIC CARD CONNECTOR WITH IMPROVED ADAPTER DEVICE

BACKGROUND OF THE INVENTION

1. Field of the Invention

The present invention relates to an electronic card connector, and particularly to an electronic card connector having an improved adapter device.

2. Description of the Art

Commonly, several means are adopted for electrically connecting an electronic card connector to a Printed Circuit Board (PCB). One such means is directly electrically connecting conductive contacts of a card connector with a PCB, as is disclosed in Taiwan application No. 84101873. Another means is using an adapter device, such as an adapter board or the like, which is adapted for electrically connecting a card connector to a PCB, as is disclosed in Taiwan application No. 85214724 and U.S. Pat. No. 5,636,999.

Referring to FIG. 4, a conventional card connector 6 comprises an insulative housing 60, two rows of conductive contacts 62 retained in the housing 60, a conductive plate 63 covering the housing 60 and an adapter device 70. The adapter device 70 includes an orientation member 71 and an adapter 75 adapted to be attached to a PCB (not shown). The orientation member 71 defines a receiving space 713 for partially receiving the contacts 62 and the conductive plate 63. The adapter 75 includes a main body 751 having an unsymmetrical structure, a plurality of conductive terminals 753 retained in the main body 751 and a grounding plate 756 retained on an outside of the main body 751. Each conductive terminal 753 comprises a curved contacting portion 7532 for engaging with a corresponding conductive contact 62, and a horizontal tail portion 7534 for soldering to the PCB. The grounding plate 756 forms a vertical section 7562 for contacting the conductive plate 63, and a horizontal soldering section 7564 for soldering to the PCB. Using this means, the card connector 60 is electrically connected to the PCB by the adapter device 70.

However, since the electrical connection between the conductive plate 63 and the adapter 75 is plate-to-plate, the conductive contact therebetween does not reliably ensure an effective grounding circuit. Additionally, the adapter 75 is relatively difficult to manufacture due to its unsymmetrical structure.

Hence, an electronic card connector having an improved adapter device is required to overcome the disadvantages of the prior art.

BRIEF SUMMARY OF THE INVENTION

A first object of the present invention is to provide an electronic card connector having an improved adapter device which provides an effective grounding function; and A second object of the present invention is to provide an electronic card connector having an improved adapter device which is easy to manufacture.

An electronic card connector in accordance with the present invention is adapted for being mounted onto a PCB. The card connector comprises an insulative housing, a plurality of conductive contacts retained in a corresponding number of passageways defined in the housing, a conductive plate and an adapter device. The conductive plate forms a shielding section covering a top of the housing and a grounding section extending vertically downward from the shielding section. The adapter device comprises an orientation member and an adapter adapted for being mounted onto the PCB. The adapter is constructed to have a symmetric structure, and includes a dielectric body, a plurality of pairs of conductive terminals and grounding contacts retained in opposite sides of the dielectric body for conductively contacting with the conductive contacts and the grounding section of the conductive plate, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
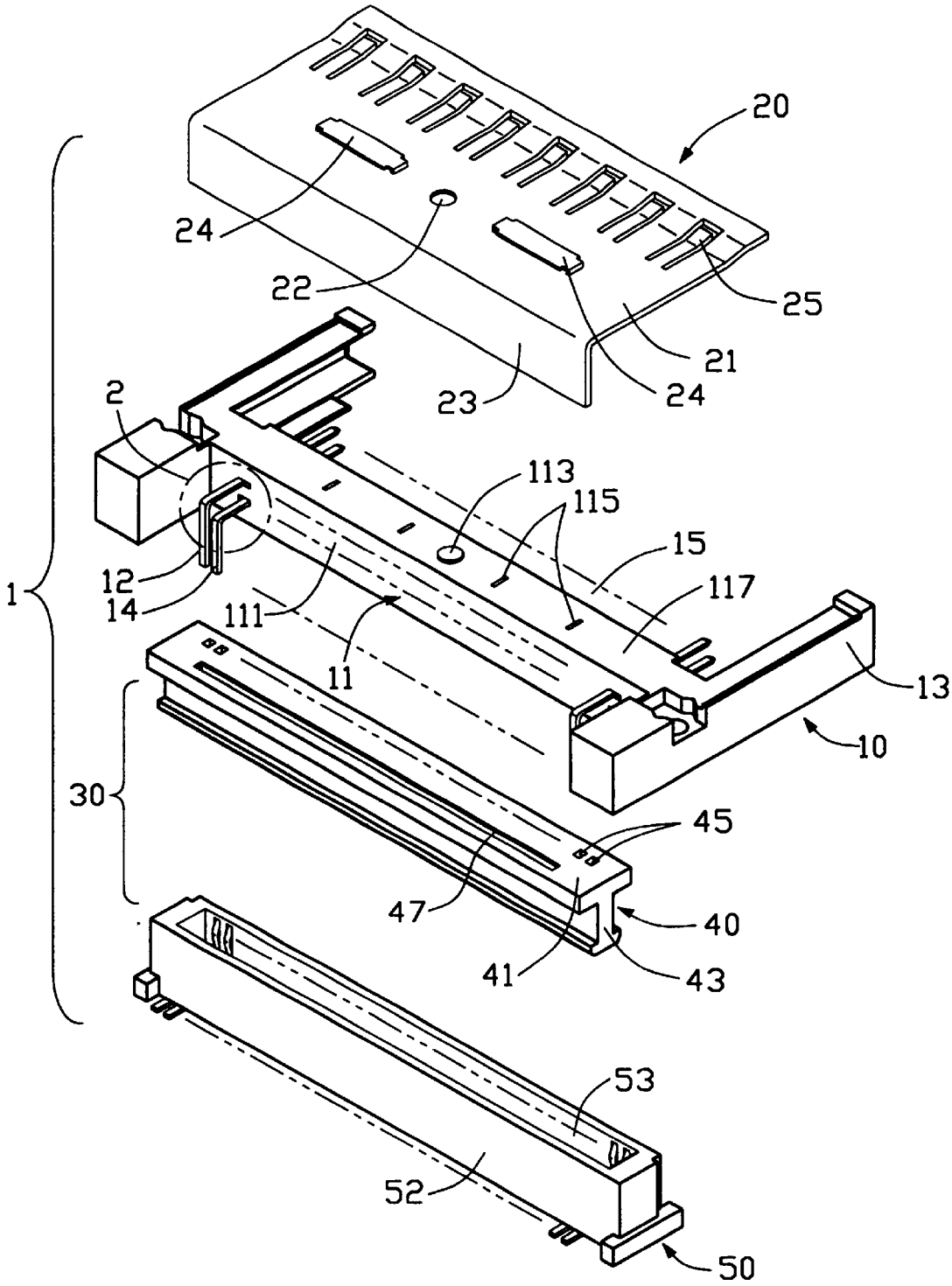
FIG. 1 is an exploded perspective view of an electronic card connector of the present invention.

Referring to FIG. 1, an electronic card connector 1 in accordance with the present invention comprises an insulative housing 10, two rows of conductive contacts 12, 14 retained in the housing 10, a conductive plate 20 and an adapter device 30 for being mounted on a PCB (not shown).

Figure 2:
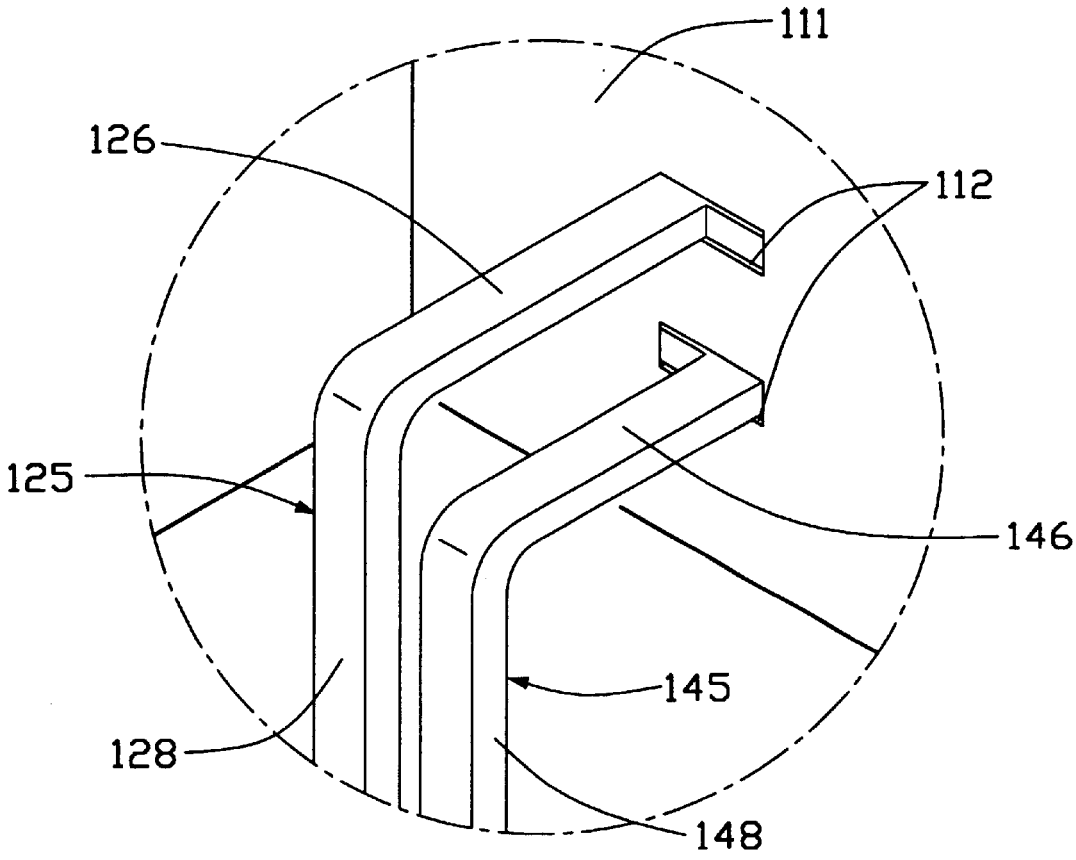
FIG. 2 is a partial enlarged view of FIG. 1 enclosed by on a circle 2.
Figure 3:
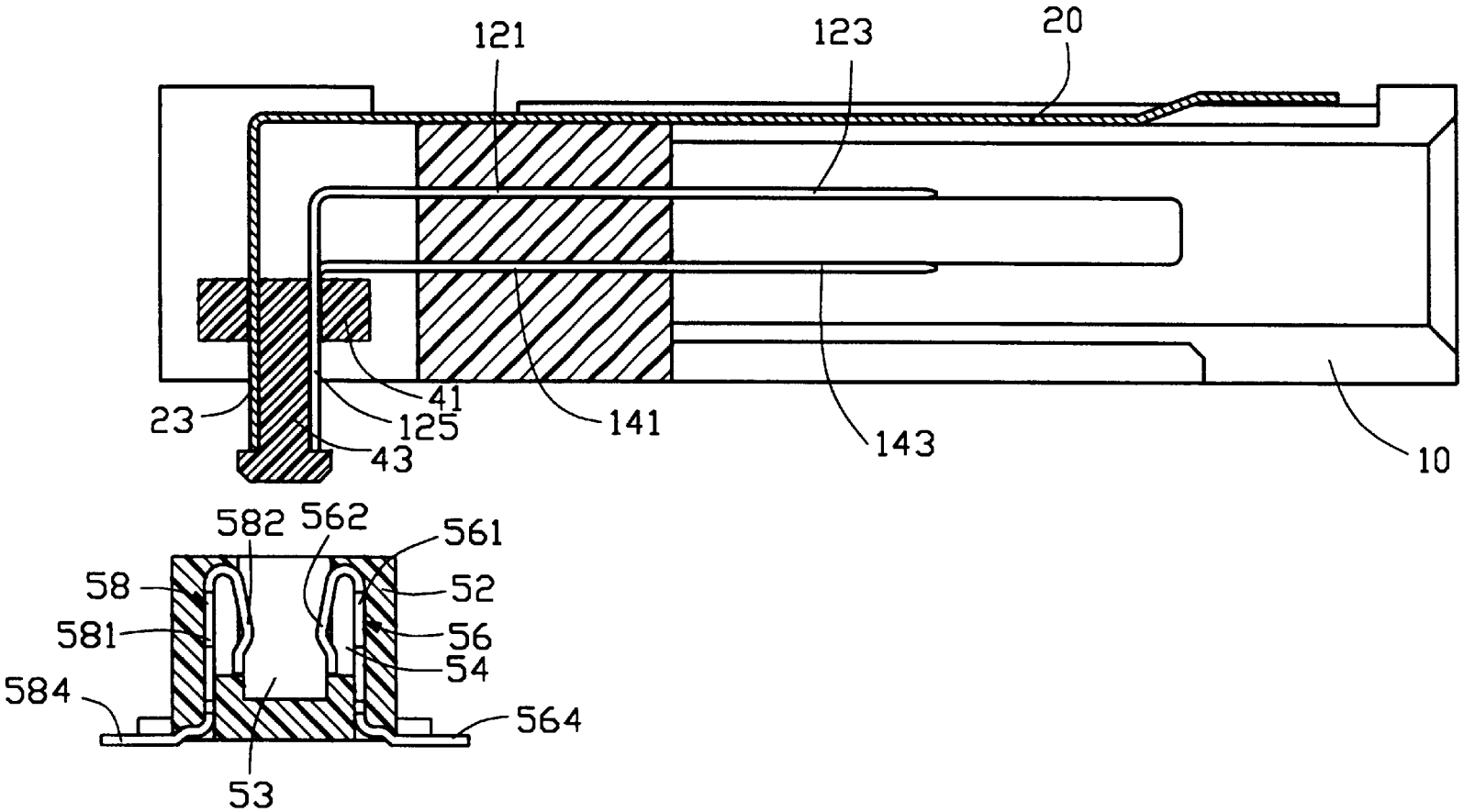
FIG. 3 is a cross-sectional view of FIG. 1 wherein the card connector is partially assembled.
Figure 4:
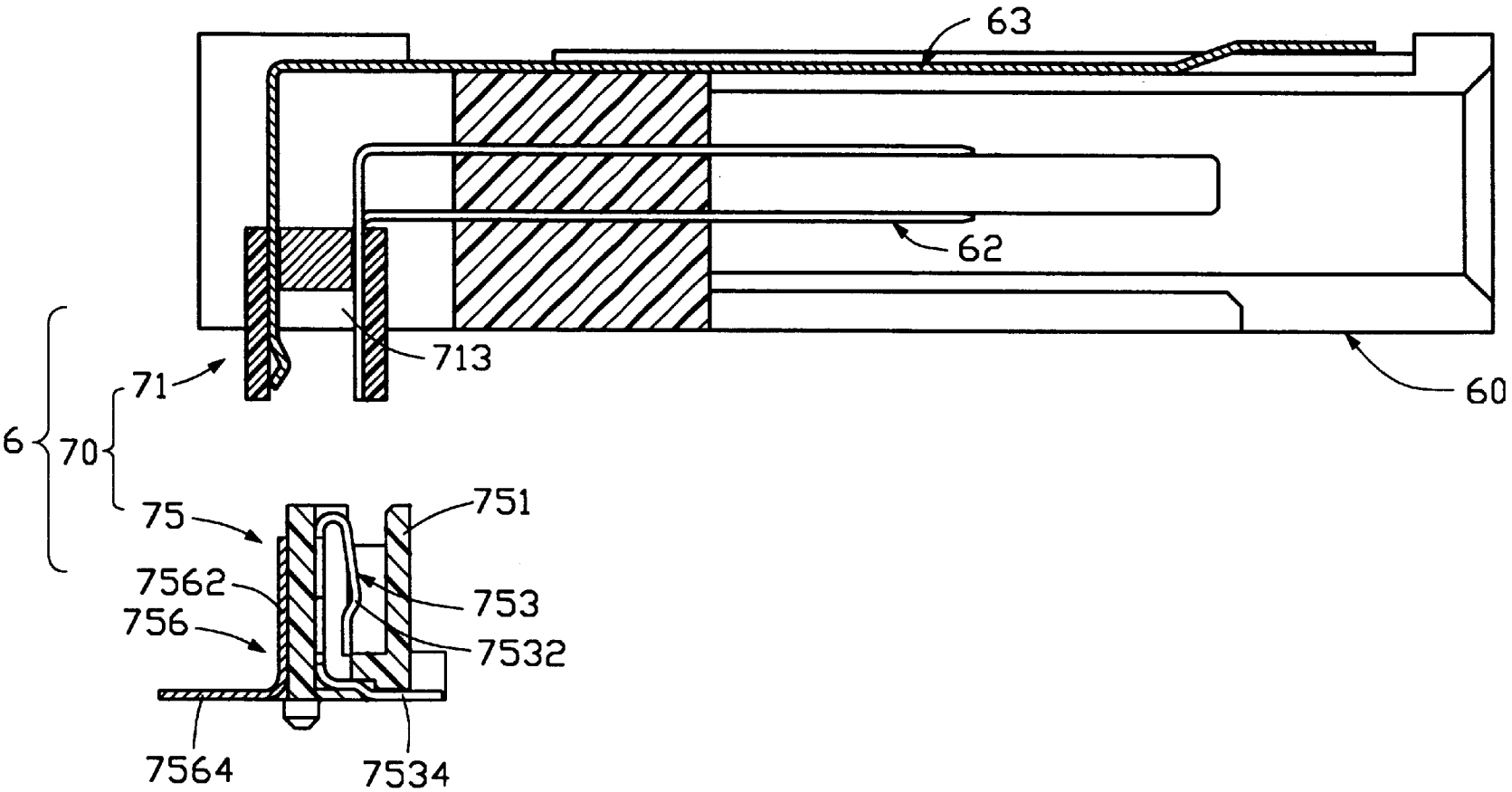
FIG. 4 is a cross-sectional view of a conventional electronic card connector partially assembled.

Further referring to FIGS. 2 and 3, the insulative housing 10 comprises an elongated main body 11 and a pair of arms 13 projecting from opposite ends of the main body 11, the main body 11 and the arms 13 cooperatively defining a receiving space 15 for receiving an electronic card (not shown) therein. The main body 11 defines an upper and a lower rows of passageways 112 extending from a front surface 111 to a rear surface (not labeled) thereof, and two pairs of slits 115 in a top surface 117 thereof. A projection 113 extends upward from a middle portion of the top surface 117 and is located between the two pairs of slits 115. Each conductive contact 12/14 comprises a retaining portion 121/141 retained in a corresponding passageway 112, a mating portion 123/143 and a contacting portion 125/ 145 extending from opposite ends of the retaining portion 121/ 141. The mating portions 123/143 extend horizontally into the receiving space 15 for conductively contacting with terminals (not shown) of the electronic card. Each contacting portion 125/145 extends horizontally from a respective retaining portion 121/141 for substantially half a width of the respective retaining portion 121/141, thereby forming a horizontal section 126/146. Vertical sections 128/148 perpendicularly extend from respective horizontal sections 126/ 146, and are arranged in a single row.

The conductive plate 20 comprises a horizontal shielding section 21 and a grounding section 23 vertically extending from one end of the shielding section 21. A plurality of gold fingers 25 are formed on the shielding section 21 to conductively contact the inserted electronic card. The shielding section 21 further comprises a pair of separate latching tabs 24 which assemble therewith to engage with the slits 115 of the housing 10. A through hole 22 is defined in the shielding section 21 between the latching tabs 24 to engage with the projection 113 of the insulatiave housing 10.

Referring to FIGS. 1 and 3, the adapter device 30 comprises an orientation member 40 and an adapter 50 for being mounted on a PCB (not shown).

The orientation member 40 has a "T"-shaped cross-section and includes a horizontal orientation section 41 and a latching section 43 depending downward from a middle of the orientation section 41. The orientation section 41 defines a row of orientation holes 45 and an elongated slot 47 in opposite sides thereof for accommodating the vertical sections 128/148 of the conductive contacts 12/14 and the grounding section 23 of the conductive plate 20, respectively.

The adapter 50 comprises a dielectric body 52 defining a central slot 53, and a plurality of pairs of conductive terminals 56 and grounding contacts 58 retained in the dielectric body 52. The dielectric body 52 further defines two rows of retaining slots 54 in opposite sides thereof, and each retaining slot 54 communicates with the central slot 53. The conductive terminals 56 and the grounding contacts 58 have symmetric structures with respect to a central axis (not labeled) of the central slot 53 when assembled in the dielectric body 52. Each of the conductive terminals 56 and grounding contacts 58 comprises a retaining portion 561/581 retained in a corresponding retaining slot 54, a mating portion 562/582 and a soldering portion 564/584 extending from opposite ends of the retaining portion 561/581. The mating portions 562 and 582 extend into the central slot 53 for mating with corresponding vertical sections 128/148 of the conductive contacts 12/14 and with the grounding section 23 of the conductive plate 20, respectively. The soldering portions 564 and 584 horizontally extend outward from opposite sides of the dielectric body 52 for soldering to the PCB.

In assembly, referring to FIGS. 1 to 3, the conductive plate 20 is first assembled to the insulative housing 10 with the latching tabs 24 and the through hole 22 thereof engaging with the pairs of slits 115 and the projection 113 of the housing 10, respectively. The adapter 50 is then mounted onto the PCB with the soldering portions 564, 584 thereof being soldered to corresponding pads (not shown) of the PCB. The vertical sections 128/148 of the conductive contacts 12/14 and the grounding section 23 of the conductive plate 20 are inserted into corresponding orientation holes 45 and into the elongated slot 47 of the orientation member 40, respectively, and are separated from each other by the latching section 43. Finally, the orientation member 40 is assembled to the adapter 50 with the latching section 43 thereof being latched in the central slot 53 of the adapter 50. At the same time, the vertical sections 128/148 of the conductive contacts 12/14 and the grounding section 23 of the conductive plate 20 engage with corresponding mating portions 562/582 of the conductive terminals 56 and with the grounding contacts 58, respectively. Using this arrangement, the card connector 1 is electrically connected to the PCB using the adapter device 30 and provides an improved grounding function since the electrical connection between the conductive plate 20 and the adapter device 30 comprises a plurality of point-to-point connections. Furthermore, since the adapter device 30 is constructed with a symmetric structure, it is easy to manufacture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic card connector adapted for being mounted onto a printed circuit board, comprising:

an insulative housing and a plurality of conductive contacts retained in a corresponding number of passageways defined in the housing;

a conductive plate being assembled to the housing and including a grounding section; and an adapter being mounted onto the printed circuit board and having a symmetric structure, the adapter having a dielectric body and a plurality of pairs of conductive terminal and grounding contact retained in opposite sides of the dielectric body for conductively contacting with the conductive contacts and with the grounding section of the conductive plate, respectively.

2. The electronic card connector as claimed in claim 1, wherein the dielectric body of the adapter defines a central slot and a plurality of pairs of retaining slots in opposite sides thereof for retaining the pairs of conductive terminals and grounding contacts, respectively, each retaining slot communicating with the central slot.

3. The electronic card connector as claimed in claim 2, wherein the conductive terminals and the grounding contacts have symmetric structures with respect to the central slot.

4. The electronic card connector as claimed in claim 3, wherein each of the conductive terminals and the grounding contacts comprises a retaining portion retained in a corresponding retaining slot, a mating portion extending from one end of the retaining portion into the central slot and a soldering portion extending horizontally from the other end of the retaining portion for soldering to the PCB.

5. The electronic card connector as claimed in claim 4, wherein the mating portions of the conductive terminals and the grounding contacts engage with the conductive contacts and with the grounding section of the conductive plate, respectively.

6. The electronic card connector as claimed in claim 1, wherein the insulative housing forms a main body defining and upper and a lower rows of passageways for receiving retaining portions of the conductive contacts.

7. The electronic card connector as claimed in claim 1, wherein each conductive contact further comprises a contacting portion having a horizontal section substantially half a length of a corresponding retaining portion in length.

8. The electronic card connector as claimed in claim 7, wherein the contacting portions of the conductive contacts comprise vertical sections arranged in a single row.

9. The electronic card connector as claimed in claim 2, further comprising an orientation member which has a "T"-shaped cross-section and comprises an orientation section and a latching section depending from a middle of the orientation section for latching into the central slot of the adapter.

10. The electronic card connector as claimed in claim 9, wherein the orientation section defines in opposite sides thereof a row of orientation holes and an elongated slot for receiving the vertical sections of the conductive contacts and the grounding section of the conductive plate, respectively.

11. An electrical card connector assembly comprising:

an insulative housing with two rows of contacts therein, tail sections of said two rows of contacts being arranged in one row and extending downwardly on a rear portion of the housing;

a conductive plate assembled to the housing with elongate grounding section downwardly extending beside the tail sections opposite to the housing; and an adapter positioned on the rear portion of the housing under the contacts and the conductive plate, said adapter including a dielectric body defining a central slot with two rows of terminals by two sides of said central slot; wherein one row of terminals are engaged with the tail sections of the contacts while the other row of terminals, which define mirror images with said row of terminals relative to the central slot, are engaged with the grounding section.

12. The assembly as claimed in claim 11, wherein an orientation member is sandwiched between the tail sections of the contacts and the grouding section, and received within the central slot.

* * * * *